US008475655B2

(12) United States Patent
Sasaki et al.

(10) Patent No.: US 8,475,655 B2
(45) Date of Patent: Jul. 2, 2013

(54) FILTER INSERT FOR CURB INLET DRAIN

(75) Inventors: Derek Sasaki, Vancouver, WA (US); Roni Sasaki, Vancouver, WA (US)

(73) Assignee: Metrochem, Inc., Vancouver, WA (US)

( * ) Notice: Subject to any disclaimer, the term of this patent is extended or adjusted under 35 U.S.C. 154(b) by 295 days.

(21) Appl. No.: 13/039,196

(22) Filed: Mar. 2, 2011

(65) Prior Publication Data

US 2012/0222995 A1 Sep. 6, 2012

(51) Int. Cl.
*E03F 5/14* (2006.01)
*E03F 5/04* (2006.01)

(52) U.S. Cl.
CPC ..... *E03F 5/0404* (2013.01); *E03F 5/14* (2013.01)
USPC ..... 210/162; 210/163; 210/170.03; 210/232; 210/471; 210/474; 210/495; 404/4; 29/428

(58) Field of Classification Search
USPC ..... 210/162, 163, 170.03, 232, 470, 210/471, 474, 495; 404/4, 5; 29/428
See application file for complete search history.

(56) References Cited

U.S. PATENT DOCUMENTS

| | | | |
|---|---|---|---|
| 1,310,773 | A | 7/1919 | Wills |
| 1,652,970 | A | 12/1927 | Workman |
| 1,961,947 | A | 6/1934 | Sieling |
| 2,496,757 | A | 2/1950 | Sieling |
| 3,282,430 | A | 9/1966 | Kinne |
| 3,713,539 | A | 1/1973 | Thompson et al. |
| 4,419,232 | A | 12/1983 | Arntyr et al. |
| 5,372,714 | A | 12/1994 | Logue, Jr. |
| 5,575,925 | A | 11/1996 | Logue, Jr. |
| 5,733,445 | A | 3/1998 | Fanelli |
| 5,954,952 | A | 9/1999 | Strawser, Sr. |
| 6,010,622 | A | 1/2000 | Chinn et al. |
| 6,045,691 | A | 4/2000 | McDermott |

(Continued)

FOREIGN PATENT DOCUMENTS

| | | | |
|---|---|---|---|
| JP | 11222915 | A | 8/1999 |
| WO | 88/03201 | A1 | 5/1988 |

OTHER PUBLICATIONS

Ultra Curb Guard, Insert Style, UltraTech International, Inc. 2009 General Catalog, p. 62.

(Continued)

*Primary Examiner* — Christopher Upton
(74) *Attorney, Agent, or Firm* — Marger, Johnson & McCollom, P.C.

(57) ABSTRACT

The curb inlet filter includes a filter bag having an opening at an upper end leading into an interior of the filter bag and a support bar coupled to one side of the upper end of the filter bag. The support bar is configured to rest outside of the basin against curb face sides bounding the opening in the street level curb face. A support frame is coupled to a second side of the upper end of the filter bag and is configured to engage with the support bar to suspend the support frame substantially at grade within an interior of the basis and define a rigid opening into the filter bag. The remainder of the filter bag hangs below grade within the curb side drain basin.

20 Claims, 5 Drawing Sheets

U.S. PATENT DOCUMENTS

| | | | | |
|---|---|---|---|---|
| 6,059,964 | A | 5/2000 | Strawser, Sr. | |
| 6,086,758 | A | 7/2000 | Schilling et al. | |
| 6,093,314 | A | 7/2000 | Wilson et al. | |
| 6,214,216 | B1 | 4/2001 | Isaacson | |
| 6,294,095 | B1 | 9/2001 | Lewis | |
| 6,805,804 | B2 | 10/2004 | Page | |
| 6,811,708 | B2 * | 11/2004 | Shaw et al. | 210/162 |
| 6,884,343 | B2 * | 4/2005 | Harris et al. | 210/163 |
| 7,083,721 | B2 | 8/2006 | McClure et al. | |
| 7,201,843 | B2 | 4/2007 | Sasaki et al. | |
| 7,357,861 | B2 | 4/2008 | Kelley et al. | |
| 7,455,766 | B1 | 11/2008 | Lewis | |
| 7,563,364 | B2 | 7/2009 | Shaw et al. | |
| 8,343,357 | B2 * | 1/2013 | Horner | 210/170.03 |
| 2007/0138074 | A1 * | 6/2007 | Howard | 210/163 |

OTHER PUBLICATIONS

Ultra-GrateGuard, Curb-Style, UltraTech International, Inc. Catalog, Date Unknown, p. 8.

Hydro FloGard Plus—Catch Basin Insert, Hydro International Stormwater, 2008, 2 pages.

California Curb Shelf Basket Water Cleansing System San Diego Regional Standard Curb Inlet, 2004, 1 page.

U.S. Department of Transportation, Underground Disposal of Storm Water Runoff, Design Guidelines Manual, Feb. 1980, Table of Contents pp. xiv-xv, pp. 195-196, Appendix E-2 pp. E-2-1-E-2-6.

* cited by examiner

FILTER INSERT FOR CURB INLET DRAIN

BACKGROUND OF THE INVENTION

This invention relates generally to storm water sewer systems, and more particularly to a drain insert adapted specifically for curb inlet drains to prevent sediment or debris such as leaves, sand, stones, gravel and, in some cases, petroleum products, from entering into the storm water removal system.

There is increased importance being placed by cities on water treatment prior to the water entering the storm sewer system. Several treatment problems have been identified: storm water run-off is contaminated with heavy metals and hydrocarbons which have leaked onto the streets and highways from a variety of sources, and leaves and other debris enter through the storm drain grate and clog storm basins outflows. In a typical storm water collection system, ground water from heavy rains or melted snow is collected in a storm sewer catch basin and flows into an underground sewer line. The water flows into the basin through openings in a grate on the top of the basin.

Water entering a sewer line should be free of solids. Early storm sewer filters removed solids from the water before the water flowed into the catch basin. These filters were made of a porous material and were located at or above grade level, which were readily visible. A very early version of this method simply used stacked hay bales around the periphery of the storm drain grate. The filters were typically placed horizontally on the top of the grate or, like the hay bales, stood up vertically in a circle above grade level, surrounding the grate. Water flowed freely through the filter and into the catch basin. Solids were captured by the filter. Over time, the solids built up on the filter, thereby impeding the free flow of water through the filter. As a result, the collected water flooded the area surrounding the storm sewer.

More modern catch basin inserts have been developed that can be installed below grade so that the solids are filtered from water without impeding the flow of water through the catch basin and into the sewer. Additionally, such filters were designed to be readily removed from the catch basin for dumping when filled with sediment and debris. Some examples of these types of filters are U.S. Pat. No. 5,575,925 (Logue, Jr.), and U.S. Pat. No. 6,086,758 (Schilling et al.), U.S. Pat. No. 6,093,314 (Wilson et al.), U.S. Pat. No. 6,059,964 (Strawser), and U.S. Pat. No. 6,045,691 (McDermott). These designs, while an improvement over the above-ground filters, suffer from several drawbacks. The Logue design, for instance comprises a filter bag with flaps that extend out from the periphery of the grate so that the grate anchors the filter bag within the catch basin. When the grate is lifted, however, the bag is subject to slide into the catch basin. The remaining prior art uses rigid frames that are adapted to fit a specifically sized drain opening and were thus not easily adaptable to differently sized or shaped openings.

An improved drain filter insert is described in U.S. Pat. No. 7,201,843 (Sasaki) and includes a size-adjustable rigid frame. Such a design, however, is adapted only for use with catch basin openings in which all sides of the rigid frame may be supported by the basin recess into which the grate rests. Curb inlet drains, formed through curb-sides on the edges of streets, have no such complementary support structure and would not work with such a design.

Accordingly, the need remains for a drain filter adapted specifically for use with curb inlet drains that overcomes the drawbacks of the prior art.

SUMMARY OF THE INVENTION

The invention comprises both a curb inlet filter as well as methods for installing such a filter within a curb-side drain, where the drain of a type including a below-grade basin having an at-grade, elongated opening aligned with an opening in a street-level curb face.

The curb inlet filter includes a filter bag having an opening at an upper end leading into an interior of the filter bag and a support bar coupled to one side of the upper end of the filter bag. The support bar is configured to rest outside of the basin against curb face sides bounding the opening in the street level curb face. A support frame is coupled to a second side of the upper end of the filter bag and is configured to engage with the support bar to suspend the support frame substantially at grade within an interior of the basis and define a rigid opening into the filter bag.

In another aspect of the invention, the curb-side drain filter bag comprises a first filter fabric panel having a bottom edge, top edge, and side edges, and a second filter fabric panel having a bottom edge, top edge and side edges. The first fabric panel is dimensioned to be longer than the second filter fabric panel so that an upper portion extends past the second filter fabric panel. The second filter fabric panel is joined along bottom and side edges to respective bottom and side edges of the first filter fabric to foam an opening into the filter bag, with upper side edge portions of the first filter fabric not being joined to the second filter fabric panel to form a free expanse. Loops are formed within at a top edge of the first and second filter fabric panels, and a support frame partially received within the loops of the second filter fabric panel. The support frame includes exposed terminal portions approximately equal in length to the free expanse of the first filter fabric panel. A support bar is received within the loops of the first filter fabric panel and is slidingly coupled to terminal ends of the support frame terminal portions. In its assembled condition, the support bar and support frame form a rigid opening into an interior of the filter bag with the expanse configured to guide water and debris into the interior of the filter bag when the bag is installed within a curb-side drain.

In the inventive method for installing a curb inlet filter into a curb-side drain, an elongate rigid portion of the filter is installed at grade level outside of a curb-side drain basin. A semi-rigid spring portion of the filter is suspended at grade within the curb-side drain basin. The elongate rigid portion and semi-rigid spring portion are coupled together to define an opening into the curb inlet filter, with a remaining portion of the curb drain filter disposed below grade in the drain basin so that water and debris flowing into the curb-side drain fall through the opening into an interior of the curb inlet filter and water exits through holes formed in the filter but that debris is retained therein.

When not possible to install the filter through the curb-side drain opening, as when vertical support members are positioned within the drain opening, the filter may be installed within the basin through a man hole opening located proximate the basin. In this case, the method further includes inserting all of the curb inlet filter except a support bar through the man hole opening and positioning the upper portion of the filter through the curb-side drain opening. The support bar is then coupled to the upper portion from outside of the curb side drain to rest outside of the basin against curb face sides bounding the opening in the street-level curb face.

The foregoing and other objects, features and advantages of the invention will become more readily apparent from the following detailed description of a preferred embodiment of the invention that proceeds with reference to the accompanying drawings.

DETAILED DESCRIPTION

Figure 1:
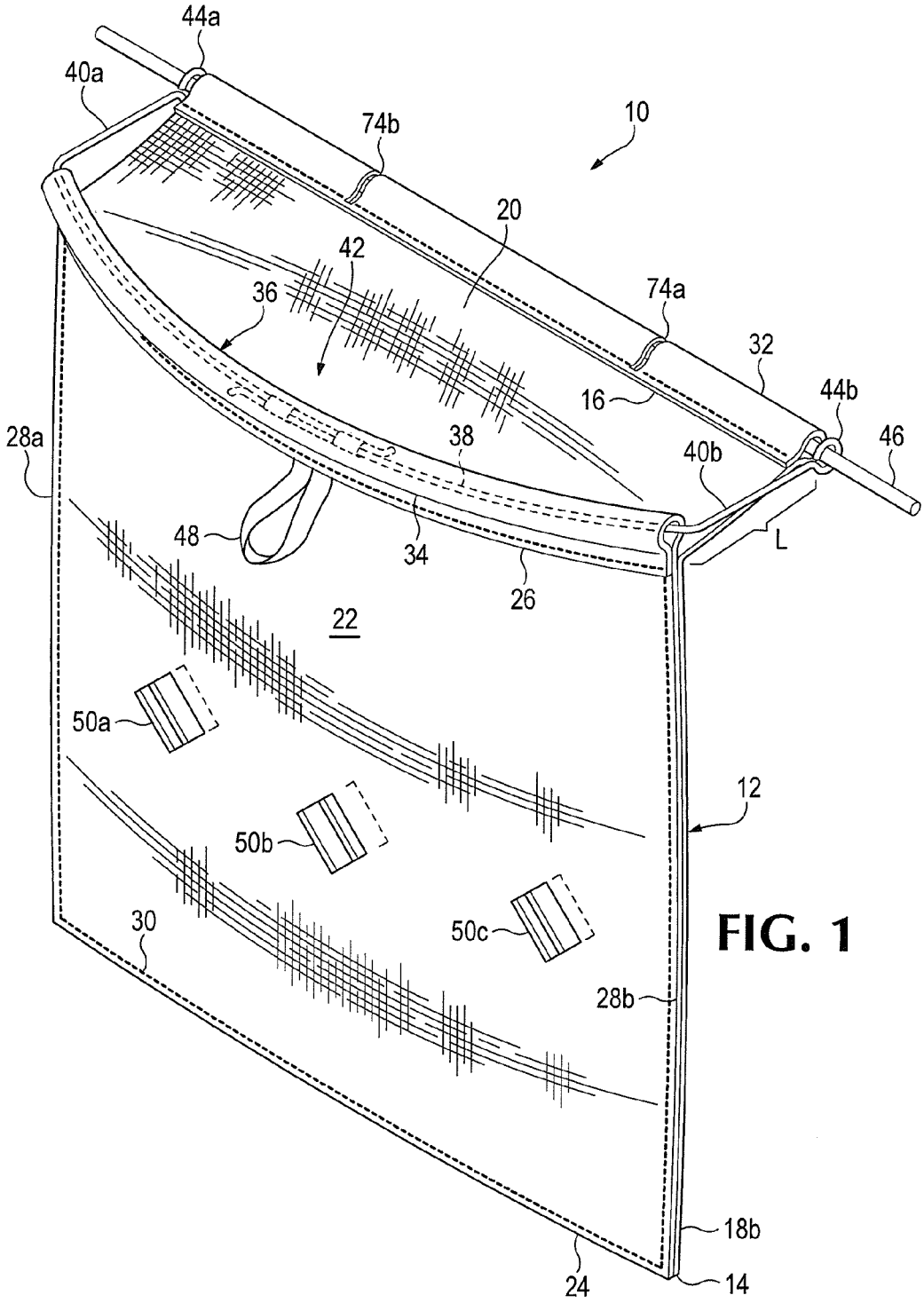
FIG. 1 is a perspective view of the curb-side drain filter configured according to a preferred embodiment of the invention.

A catch basin filter bag for use with a curb side drain and constructed according to a preferred embodiment of the invention is shown generally at 10 in FIG. 1. Filter bag 10 includes a first fabric filter panel 12 having a bottom edge 14, top edge 16, and side edges 18*a*, 18*b*. Also included is a second fabric filter fabric 22 having a bottom edge 24, top edge 26, and side edges 28*a*, 28*b*. The panels are sized so that first fabric filter panel 12 is longer than second filter fabric panel 22 by an amount L that forms, when joined together, a free expanse 20. Panels 12, 22 are formed from a flexible filter fabric such as a nonwoven geotextile, although the invention is not limited to such materials.

First and second panels 12, 22 are joined together on three sides—i.e. first panel bottom edge 14 to respective second panel bottom edge 24, and respective portions of side edges 18*a*/18*b* to side edges 28*a*/28*b*—to form the filter bag 10. The panels 12, 22 are joined as by stitching 30 running about the periphery of the joined sides. As the first panel 12 is longer than the second panel 22 by length L, only a portion of first panel side edges 18*a*/18*b* are joined to the second panel side edges so that the free expanse 20 remains unjoined.

Top edges 16 and 26 are folded over to form first panel loop 32 and second panel loop 34, respectively. A support frame 36 is coupled to the second panel 22 and preferably includes spring portion 38 at least partially received within the second panel loop 34. Spring portion 38 subtends an arc away from free expanse 20 so that the top opening of filter bag is sized appropriately to admit water and debris into the interior of the bag. Support frame 36 further includes exposed terminal portions 40*a*, 40*b* of length L that are approximately equal in length to free expanse 20. As will be appreciated when describing the use of filter 10 within a curb side drain, making the support frame exposed portions 40*a*/40*b* of approximately equal length L to free expanse 20 will cause the free expanse to remain taut and help guide water and debris through the top opening 42 into the interior of the filter bag 10 when the bag is installed within a curb-side drain.

Support frame 36 is preferably constructed using a heavy gauge wire that imparts at least partial rigidity to the back part of the bag opening and allows the spring portion 38 and terminal portions 40*a*/40*b* to flex in order to accommodate installation of the filter bag 10 within curb side drains of different widths. Terminal ends of respective portions 40*a*/40*b* are formed into rigid loops 44*a*/44*b* and receive an elongate support bar 46 therethrough as will be described further below.

Figure 2:
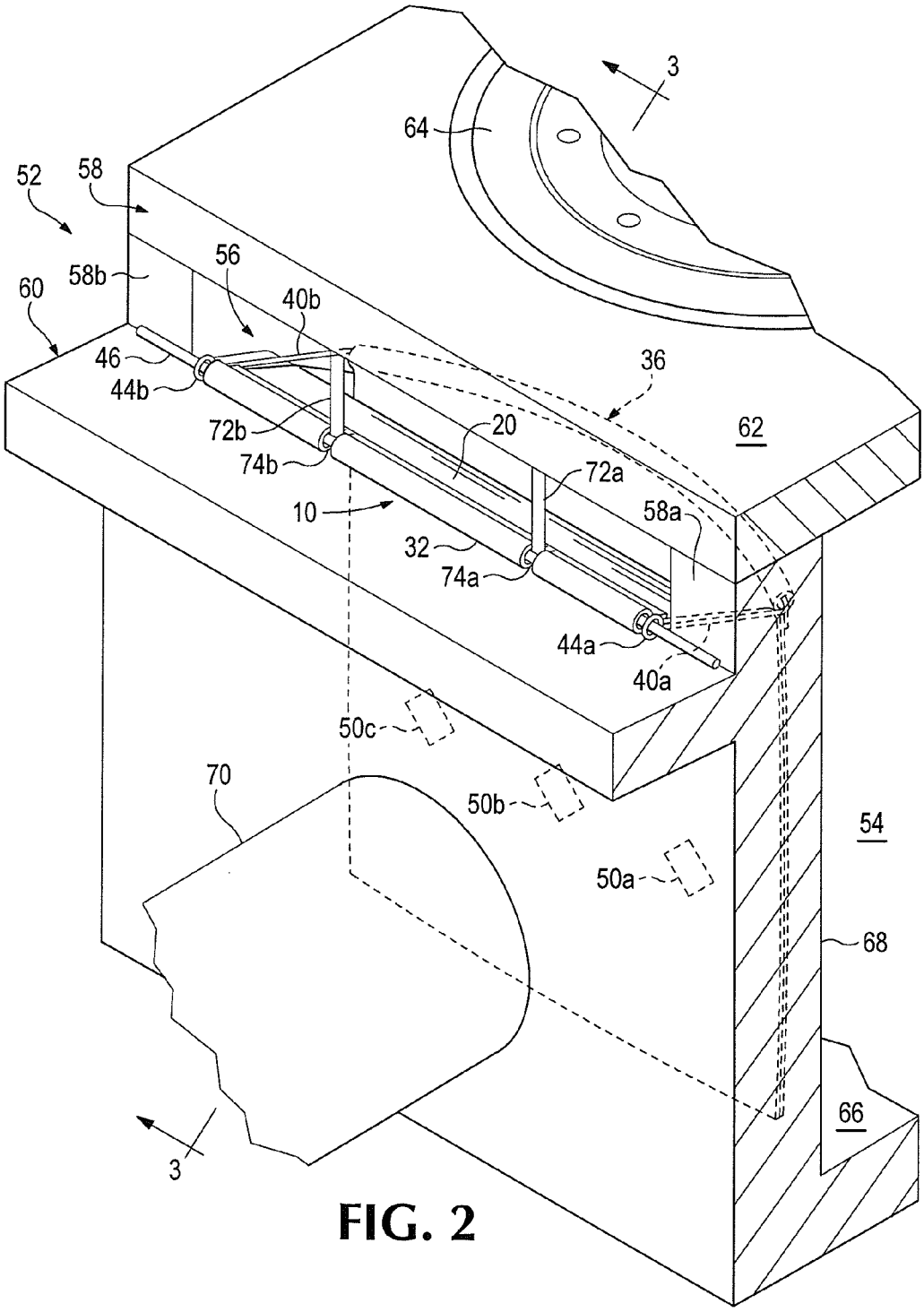
FIG. 2 is a street-side perspective view showing the inventive filter of FIG. 1 installed within a curb-side drain.

Elongate support bar 46—preferably formed of rigid rebar—is slidingly received within front panel loop 32 and support frame loops 44*a*/44*b* and is sized so that portions extend past loops 44*a*/44*b* and rest against curb face sides bounding the curb drain opening in the street level curb face (FIG. 2). That is, bar 46 is longer than the curb-side drain opening is wide so that it retains the filter within the curb side basin and prevents the filter from sliding through the opening to the bottom of the basin. Support bar 46 and support frame 36 form a rigid opening into an interior of the filter bag 10.

Filter bag includes a pull strap 48, affixed to the filter bag 10 proximate the support frame 36, for assisting in removing the filter bag 10 from within the catch basin 54. Drain overflow holes 50*a*, 50*b*, and 50*c* are defined within the first and second panels 12, 22 and at a certain height above bottom edges 14, 24 in case the water intake into the bag is greater than can naturally be released through the holes of the filter fabric and to prevent the bag from overflowing and causing water to puddle up on the street outside of the curb-side drain.

FIG. 2 shows a street-side perspective view of filter bag 10 installed within a curb-side drain 52 of a type including a below-grade basin 54 having an at-grade, elongated opening 56 aligned with an opening in a street-level curb face 58. Street level 60 defines grade, and basin 54 includes a concrete top cap 62 fitted with a man hole cover 64 for access to the basin 54. Basin 54 is lined with a concrete floor 66 and wall 68, with an outflow sewer pipe 70 drawing water and waste from within basin into the sewer system.

Filter bag 10 has an opening 42 at an upper end leading into an interior of the filter bag. Support bar 46 is coupled to one side 12 of the upper end of the filter bag 10 and is configured to rest outside of the basin 54 against curb face sides 58*a*/58*b* bounding the opening 56 in the street level curb face. A support frame 36 is coupled to a second side 22 of the filter bag 10 and is configured to engage with the support bar 46 so as to suspend the support frame substantially at grade 60 within an interior of the basin 54 and define a rigid opening 42 into the filter bag.

The support frame 36 includes an arc portion 38 received within the loops 34 of second panel 22, and exposed terminal portions 40*a*/40*b* having a length L approximately equal to a difference in length between the first panel 12 and second panel 22. The support frame 36 subtends an arc such that a semicircular opening 42 into the interior of the filter bag 10 is defined when the support frame 36 is engaged with the support bar 46.

Curb-side drain opening 56 is typically a rectangular opening formed in the curb-face 58 flanking the street 60. Installing the curb inlet filter 10 into the curb-side drain includes installing the elongate rigid portion 46 of the filter at grade level 60 outside of the curb-side drain basin 54. The semi-rigid spring portion 36 is suspended at approximate grade level within the curb side drain basin 54 and the two portions are coupled together (either before or after installation) to define the opening 42 into the curb inlet filter 10. The remaining portion, e.g. lower portions of panel members 12 and 14, are disposed below grade 60 in the drain basin 54 so that water and debris flowing into the curb-side drain fall through the opening and into an interior of the curb inlet filter. Water then exits through holes formed in the filter, e.g. through the filter holes or overflow holes 50*a*-50*c*, but that debris is retained therein.

In one method for installation, the elongate rigid portion includes support bar 46 coupled to an upper portion of the filter, as through loop 32. The curb inlet filter is coupled together outside of the curb-side drain and then the entire assembly is inserted through the curb opening 56 so that only the first panel loop 32 and received elongate rigid support bar 46 remain outside of the curb-side drain basin 54.

Some curb-side drain openings include vertical rebar support members—such as members 72*a* and 72*b*—passing between the bottom and top of the opening 56 thereby complicating insertion of the inventive filter bag 10 therein. In an alternate embodiment of the device, filter bag 10 includes at least one slit formed in an upper end of the filter bag—such as slits 74*a* and 74*b* —configured to receive a respective vertical rebar support 72, 72*b* therethrough when the curb inlet filter is installed within the curb-side drain.

Figure 3:
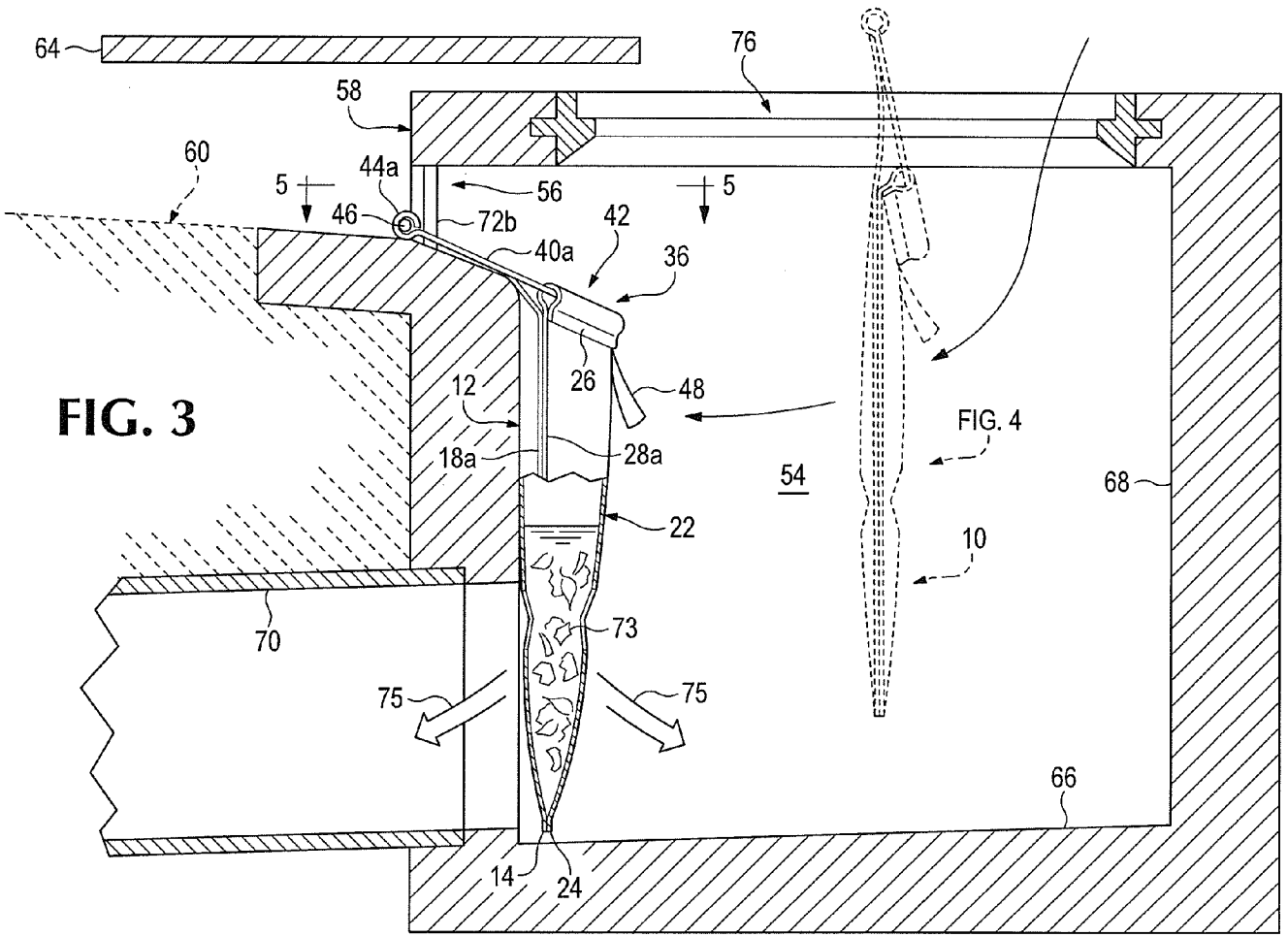
FIG. 3 is a side elevation view taken along line 3-3 in FIG. 2 showing a process for installing the inventive filter within the curb-side drain by insertion through a manhole cover installed over the catch basin, with partial cut-away showing the contents of the installed filter.
Figure 5:
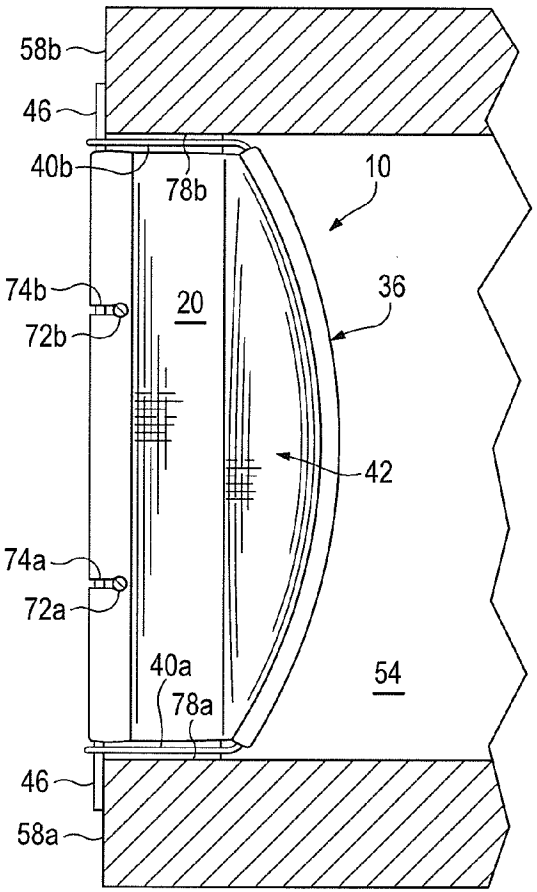
FIG. 5 is a top plan view taken along line 5-5 in FIG. 3 showing the inventive filter in a second, installed position within the catch basin and against the curb-side drain sidewalls.
Figure 4:
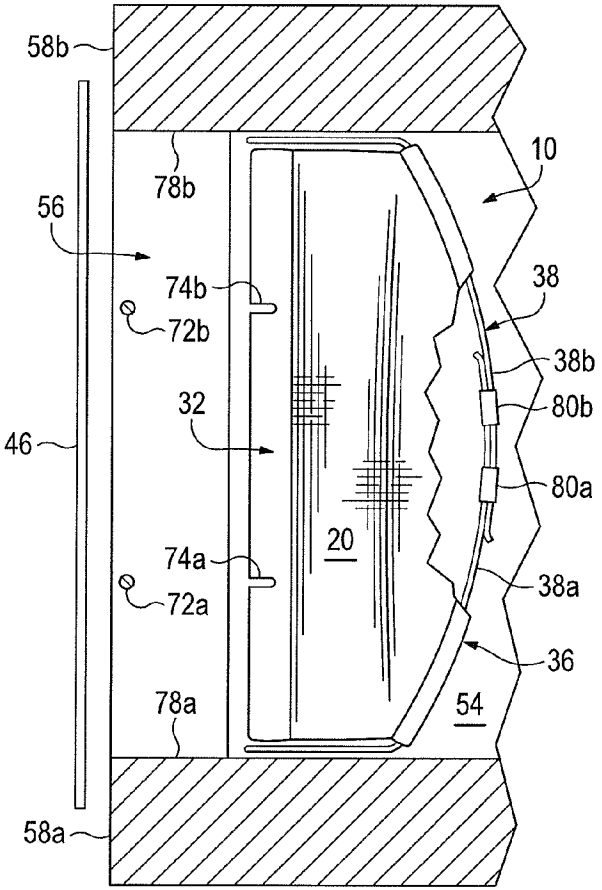
FIG. 4 is a top plan view showing the inventive filter in a first, uninstalled position within the catch basin, with partial cut-away showing the support frame adjustment means configured according to an alternate aspect of the invention.

FIGS. 3-5 illustrate an alternate method for installing the inventive filter bag 10 in the situation where curb inlet opening 56 includes interposed vertical support members 72*a*/72*b*. In this case, the man hole cover 64 is removed from overtop the basin 54 and the entire curb inlet filter 10—with the sole exception of the support bar 46 inserted through the man hole opening 76 (FIG. 4) and positioned so that the loop 32 formed in the upper portion of the filter is fed through the curb drain opening 56. Vertical support members 72*a* and 72*b* are then received through the slits 74*a*/74*b* formed in loop 32 so that part of the upper portion extends outside of the vertical supports; and the support bar 46 slid into the loop 32 from outside the basin 54 (FIG. 5). The support bar then rests against the curb face sides 58*a* and 58*b* bounding the opening in the street-level curb face 58 as shown in FIG. 2, and also against the outside facing portions of the vertical rebar members 72*a* and 72*b*. Debris 73 and water 75 falling through the top opening 42 of the filter 10 collect within the bottom of the bag, with water flowing out into the basin 54 and thence through outflow pipe 70 to the remainder of the sewer system (not shown).

Figure 7:
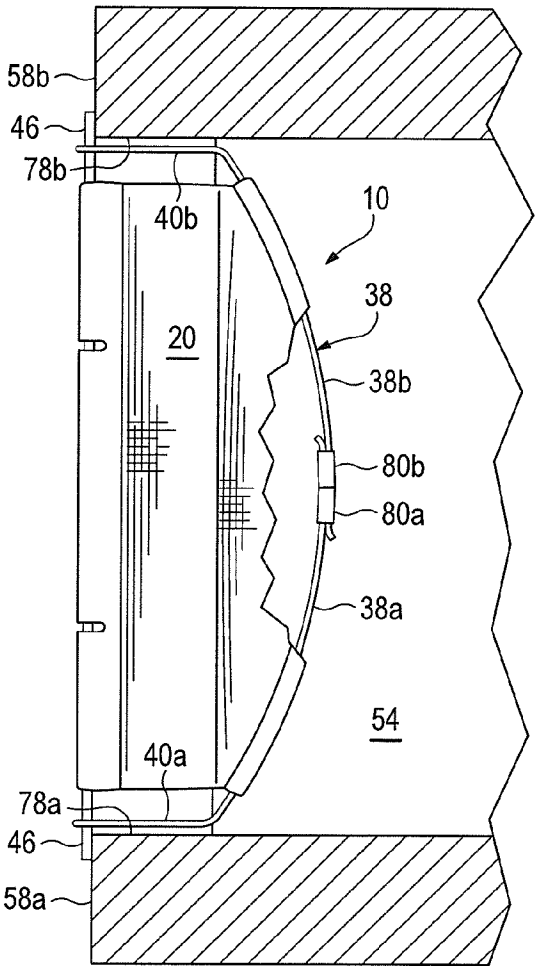
FIG. 7 is a top plan view with partial cut-away showing the filter of FIG. 5 but installed within a catch basin having an opening of a wider dimension than the one in FIG. 5.
Figure 6:
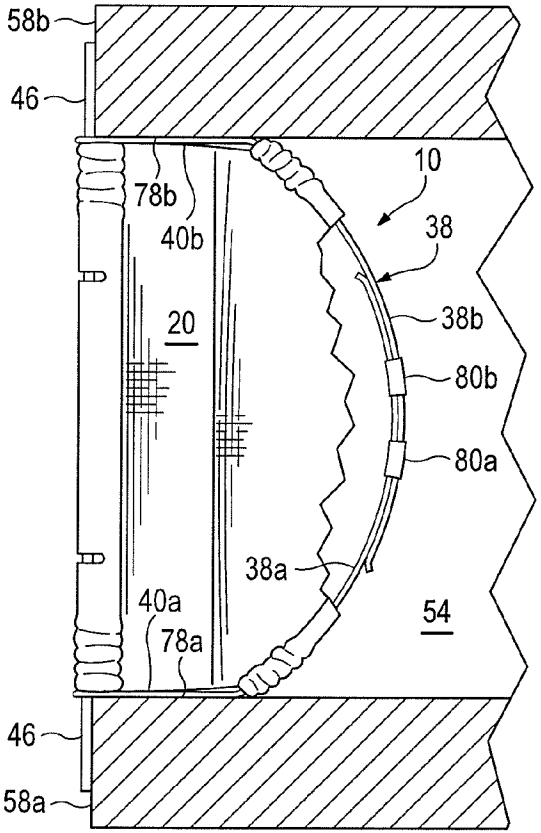
FIG. 6 is a top plan view with partial cut-away showing the filter of FIG. 5 but installed within a catch basin having an opening of a narrower dimension than the one in FIG. 5.

FIGS. 6 and 7 illustrate operation of the spring portion 38 of the support frame 36 to accommodate differing widths of curb drain openings. Spring portion 38 is made of a high gauge wire, e.g. 8-gauge steel wire, with a balance of flexibility and support to flex within the basin and between curb drain sidewalls 78*a*, 78*b*. When the curb opening 56 is narrow, as in FIG. 6, spring portion 38 bows outward to increase the size of filter bag opening 42. Furthermore, exposed terminal portions 40*a*, 40*b* bear inward and terminal end loops 44*a*, 44*b* slide inward along the elongate support bar 46 to a biased resting position against the inside walls 78*a*, 78*b* of the curb opening.

An alternate, or supplemental, adjust means is shown in the cut-away views of FIGS. 5, 6 and 7. Spring portion 38 includes two overlapping wire portions 38*a*, 38*b* that slide relative to one another within retaining members 80*a* and 80*b*. The total length of arc member 38 can then be changed by sliding the overlapping wire portions 38*a*, 38*b* relative to one another to better accommodate a width of an opening in a street-level curb face leading to the curb-side drain basin, shown by a minimal dimension in FIG. 6, a medium setting in FIG. 5, and a maximum dimension in FIG. 7.

Having described and illustrated the principles of the invention in a preferred embodiment thereof, it should be apparent that the invention can be modified in arrangement and detail without departing from such principles. We claim all modifications and variation coming within the spirit and scope of the following claims.

We claim:

1. A curb inlet filter for use with a curb-side drain, said drain of a type including a below-grade basin having an at-grade, elongated opening aligned with an opening in a street-level curb face, wherein the curb inlet filter includes:

a filter bag having an opening at an upper end leading into an interior of the filter bag;

a support bar coupled to one side of the upper end of the filter bag and configured to rest outside of the basin against curb face sides bounding the opening in the street level curb face; and a support frame coupled to a second side of the upper end of the filter bag and configured to engage with the support bar to suspend the support frame substantially at grade within an interior of the basin and define a rigid opening into the filter bag.

2. The curb inlet filter of claim 1, the filter bag having first and second filter fabric side panels joined together along side edges to form the bag, with the first side panel being longer than the second side panel.

3. The curb inlet filter of claim 2, wherein upper portions of the side panels have loops defined therein, the support bar received within loops of the first filter fabric panel and the support frame received within loops of the second side panel.

4. The curb inlet filter of claim 3, wherein upper portions of the side edges of the first filter fabric panel are not joined to the second filter fabric and define a portion of an expanse of the opening of the filter bag when the support bar and support frame are engaged together.

5. The curb inlet filter of claim 2, wherein the support frame includes an arc portion received within the loops of the second side panel, and exposed terminal portions having a length approximately equal to a difference in length between the first and second panel.

6. The curb inlet filter of claim 1, wherein the support frame subtends an arc such that a semicircular opening into the interior of the filter bag is defined when the support frame is engaged with the support bar.

7. The curb inlet filter of claim 6, wherein terminal ends of the support frame end in loops, the support bar being slidingly engaged with the loops of the support frame when engaged.

8. The curb inlet filter of claim 1, the filter bag including at least one slit formed in an upper end of the filter bag configured to receive a vertical rebar support of the curb inlet filter therethrough when the curb inlet filter is installed within the curb-side drain.

9. The curb inlet filter of claim 1, the support frame including overlapping sections moveable with respect to one another so as to change a linear dimension of the support frame so that the wire frame can accommodate drains of various dimensions.

10. The curb inlet filter of claim 1, further including a pull strap affixed to the filter proximate the support frame to assist in removing the filter from the curb-side drain basin.

11. A method for installing a curb inlet filter into a curb-side drain, the method comprising:

installing an elongate rigid portion of the filter at grade level outside of a curb-side drain basin;

suspending a semi-rigid spring portion of the filter at grade within the curb-side drain basin;

coupling the elongate rigid portion and semi-rigid spring portion together to define an opening into the curb inlet filter; and disposing a remaining portion of the curb drain filter below grade in the drain basin so that water and debris flowing into the curb-side drain fall through the opening into an interior of the curb inlet filter and water exits through holes formed in the filter but that debris is retained therein.

12. The method of claim 11, wherein the elongate rigid portion includes a support bar coupled to an upper portion of the filter, the method further including:

coupling the curb inlet filter together outside of the curb-side drain; and inserting the curb inlet filter through an opening of the curb-side drain so that only the elongate rigid portion remains outside of the curb-side drain basin.

13. The method of claim 11, wherein the elongate rigid portion includes a support bar coupled to an upper portion of the filter, the method further including:

inserting all of the curb inlet filter except the support bar through a man hole opening proximate the curb-side drain;

positioning the upper portion of the filter through an opening in a street-level curb face leading to the curb-side drain basin; and coupling the support bar to the upper portion from outside of the curb side drain to rest outside of the basin against curb face sides bounding the opening in the street-level curb face.

14. The method of claim 13, further including:

defining slits within the upper portion of the filter;

receiving vertical supports defined within the opening of the street-level curb face within the slits so that part of the upper portion extends outside of the vertical supports; and coupling the support bar to the upper portion of the filter so that the support bar rests outside of the vertical supports.

15. The method of claim 11, further including:

forming a pull strap proximate the semi-rigid spring portion;

grasping the pull strap; and removing the filter through a man hole opening proximate the curb-side drain.

16. The method of claim 11, further including flexing the semi-rigid spring portion so that terminal portions of the spring portion bias against opening sidewalls of the curb-side drain.

17. The method of claim 16, wherein the elongate rigid portion includes a support bar coupled to an upper portion of the filter, the method further including:

forming loops on terminal ends of the semi-rigid spring portion;

forming loops within the upper portion of the filter inside of the loops on the terminal ends of the semi-rigid spring portion; and slidingly receiving the support bar through the loops on the terminal ends of the semi-rigid spring portion and through loops within the upper portion of the filter inside.

18. The method of claim 11, further including:

providing slidingly overlapping sections of the semi-rigid spring portion; and adjusting a length of the spring portion by sliding the overlapping sections with respect to one another to better accommodate a width of an opening in a street-level curb face leading to the curb-side drain basin.

19. A curb-side drain filter bag comprising:

a first filter fabric panel having a bottom edge, top edge, and side edges;

a second filter fabric panel having a bottom edge, top edge and side edges, the first fabric panel being longer than the second filter fabric panel so that an upper portion extends past the second filter fabric panel;

the second filter fabric panel being joined along bottom and side edges to respective bottom and side edges of the first filter fabric to form an opening into the filter bag, with upper side edge portions of the first filter fabric not being joined to the second filter fabric panel to form a free expanse;

loops formed within at a top edge of the first and second filter fabric panels;

a support frame partially received within the loops of the second filter fabric panel and having exposed terminal portions approximately equal in length to the free expanse of the first filter fabric panel;

a support bar received within loops of the first filter fabric panel and slidingly coupled to terminal ends of the support frame terminal portions, the support bar and support frame forming a rigid opening into an interior of the filter bag with the expanse configured to guide water and debris into the interior of the filter bag when the bag is installed within a curb-side drain.

20. The curb-side drain filter bag of claim 19, wherein the support frame includes an arc portion received within the loops of the second filter fabric panel and configured to extend the opening of the filter bag and flex to fit a plurality of widths of the curb-side drain.

* * * * *